US006139973A

United States Patent [19]

Kawasaki et al.

[11] Patent Number: 6,139,973

[45] Date of Patent: Oct. 31, 2000

[54] METHOD FOR FORMING WEAR-RESISTANT LAYER AND IRON-BASED MATERIAL, ON WHICH WEAR-RESISTANT LAYER IS APPLIED

[75] Inventors: Iwao Kawasaki; Yutaka Okabayashi; Masatake Higashi, all of Tokyo, Japan

[73] Assignee: Nihon Parkerizing Co., LTD, Tokyo, Japan

[21] Appl. No.: 09/090,334

[22] Filed: Jun. 4, 1998

[30] Foreign Application Priority Data

Jun. 4, 1997 [JP] Japan ..... 9-146886

[51] Int. Cl.[7] ..... C25D 9/10

[52] U.S. Cl. ..... 428/469; 205/50; 205/316; 205/320

[58] Field of Search ..... 205/50, 106, 107, 205/108, 316, 320; 428/469

[56] References Cited

U.S. PATENT DOCUMENTS 4,239,604 12/1980 Mahdjuri ..... 204/56 R
5,187,017 2/1993 Hatano et al. ..... 428/469

OTHER PUBLICATIONS

Derwent Acc No. 1984–051379 Abstracting GB 2125067A, 1984.

*Primary Examiner*—Kathryn Gorgos
*Assistant Examiner*—William T. Leader
*Attorney, Agent, or Firm*—Armstrong, Westerman, Hattori, McLeland and Naughton

[57] ABSTRACT

A thin sulfurizing layer having high iron-sulfide content is formed by an electrolytic deposition method using an alkaline electrolytic solution which contains ferric ions, sulfide and a chelating agent of the ferric ions.

17 Claims, 4 Drawing Sheets

CARBURIZED MATERIAL
○ : $Fe_{1-n}S$
□ : FeS
△ : Fe
I (cps)
2θ
450
400
350
300
250
200
150
100
50
0
10.0
20.0
30.0
40.0
50.0
60.0
70.0
80.0
90.0

NITRIDED MATERIAL
O : $Fe_{1-n}S$
▽ : $Fe_3N$
I (cps)
700
600
500
400
300
200
100
0
10.0
20.0
30.0
40.0
50.0
60.0
70.0
80.0
90.0
2θ

METHOD FOR FORMING WEAR-RESISTANT LAYER AND IRON-BASED MATERIAL, ON WHICH WEAR-RESISTANT LAYER IS APPLIED

BACKGROUND OF INVENTION

1. Field of Invention

The present invention is related to a surface treating method for enhancing wear resistance by means of depositing a sulfurizing layer of 5 μm or less thickness, in which iron sulfide and oxide are mixed, on carbon steels for constructional use, alloy steels, special steels and iron-based forgings and castings and, more particularly, hardening heat-treated iron-based sliding parts, such as by carburizing, nitriding and induction heating. The present invention is furthermore related to iron-based material, on which the wear-resistant layer is applied.

2. Description of Related Art

The sulfur-permeation method, which is usually referred to as the sulfurizing treatment, was developed in France 1953. The following facts are known in this treatment: Active sulfur ($S^0$) is diffused into the iron surface of a workpiece and a sulfurizing layer consisting of such iron sulfides as FeS and $FeS_{1-x}$, and oxides such as FeO and $Fe_3O_4$ are formed; when the sulfurizing layer is brought into sliding contact with the opposite material, the coefficient of friction decreases, so that adhesion and fusion become difficult to occur and hence the wear resistance is improved.

The following methods are representative among the variously devised sulfurizing methods.

(1) Solid method or pack method. Heating is carried out in the solid FeS and graphite.

(2) Immersion method. A workpiece is immersed in a sulfur-containing aqueous solution or molten salt and is then heated to 300° C. or higher.

(3) Molten salt method. A workpiece is immersed, at 500° C. or higher, in neutral sodium-chloride containing salt, to which sulfur is added. Alternatively, a workpiece is immersed, at 500° C. or higher, in cyanic acid-containing salt, to which sulfur is added.

(4) Gas method. Heating is carried out in mixed gas atmosphere of hydrogen sulfide with hydrogen or ammonia at 500° C. or higher.

(5) Electrolytic method. Molten salt of thiocyanic acid is electrolyzed at 170° C. or higher.

Wear resistance of the sulfurizing layer varies depending upon various factors, such as its surface hardness and roughness, kind of material on which the sulfurizing layer is deposited, and wearing conditions, e.g., surface pressure, contacting mode and kind of lubricant. It is, therefore, very difficult to attain stable wear resistance of the sulfurizing layer, in view of the fact that the above factors greatly vary. Since surface hardness of the sulfurizing layer is considerably lower than that of the surface hardening, such as carburizing and nitriding, the sulfurizing layer applied on a low-hardness material is greatly mechanically damaged and is hence not advantageous.

Accordingly, developments have been directed toward simultaneous or consecutive sulfurizing and nitriding methods, such that a hard surface layer is first formed by nitriding and then a wear-resistant layer, i.e., a sulfurizing layer, is formed. The recently industrialized methods are reducing molten salt method based on the nitriding and modified to enable sulfurizing, the gas method and the ionic method.

In the reducing molten salt method, 10% or less of a sulfur compound such as sodium thiosulfate or sodium sulfide is added to the cyanic acid and nitriding cyanic compound. The so prepared mixture is melted and is used for sulfurizing and nitriding. The treatment temperature is as high as 500° C. or higher and the treatment time is as long as 2 hours or more. Therefore, when a high level of the sulfide content in the salt bath is selected, a large amount of iron sulfide is permeated on the workpiece, while the sulfurizing layer is liable to separate from the surface of the workpiece. In the surface region, where the sulfur concentration is high, the permeation and diffusion of nitride is so retarded that only a thin nitride layer can be formed. In order to eliminate such problems, the main trend of the reducing molten salt method is directed to a low-sulfur type with the sulfur-compound level suppressed to as low as a few percent (Japanese Examined Patent Publication (kokoku) No. 59-6911). This method can also meet the requirements to enhance the dimensional accuracy of the sulfurized parts.

When implementing the reducing molten salt method, the sulfur of the molten salt bath must be analyzed to maintain the level of sulfur and to protect the molten bath from oxidation. In addition, when the treated workpiece is washed, the cyanic acid may decompose to yield a free cyano compound. This must be subjected to waste-liquor treatment in the light of pollution control.

The gas method resides in sulfurizing and nitriding in the gas mixture environment of nitrogen, ammonia and hydrogen sulfide. The treatment temperature is as high as 500° C. or higher and the treatment time is as long as 3 hours or more. This method is flexible, since the gas composition can be optionally adjusted to control the thickness of the sulfurizing and nitrided layers. However, the hydrogen sulfide gas having high specific gravity and the ammonia gas must be uniformly mixed. The gas pressure must be controlled. The furnace must be constructed so as to maintain uniform gas composition therein. These are important factors in implementing the gas method. Furthermore, equipment plant for recovering the hydrogen sulfide gas from the waste gas must be installed, which increases the cost of the plant.

The ionic method resides in sulfurizing and nitriding by glow-discharging a gas mixture of ammonia and hydrogen sulfide under reduced pressure. The treatment time is as long as four hours or more. This method is flexible, as well, since the gas composition can be optionally adjusted to control the thickness of the sulfurizing and nitrided layers. However, this method involves similar difficulties and cost problem as in the gas method.

When the above described sulfurizing and nitriding methods are compared, all the methods share the common points that the total thickness of the sulfurized and nitrided layer is as thick as 10 μm or more thick, and further peaks of iron sulfide, such as FeS and $Fe_{1-x}S$, are detected by the X-ray diffraction. Quantitatively speaking, the ratio of X-ray diffraction peak intensity indicates that iron sulfide in the gas and ionic methods is greater than that in the reducing molten iron method. However, how much the proportion of sulfide relative to the nitride or iron oxide in the sulfurizing layer is not clear. Notwithstanding this unclarity, it is reported that the wear resistance has a relationship with the amount of iron sulfide on the specimen surface, with regard to the test specimens prepared using various kinds of materials and by changing the surface roughness.

The Corvet method, which was developed in 1964 and industrialized in 1970 in France, has a noteworthy feature that even the hardening heat-treated material such as carburized or nitrided material can be sulfurized. Its patent is entitled "Method for Sulfurizing by Anodic Electrolysis of Molten Salt" (Japanese Examined Patent Publication (kokoku) No. 63-12158). It discloses an electrolytic condition: temperature—170° C. or higher; current density—1.5–4 A/dm$^2$; and, treatment time—4–20 minutes. A layer of iron sulfide (FeS, $FeS_2$) and iron oxide (FeO, $Fe_3O_4$) is deposited on the anode under the reaction of $Fe^{2+}$ dissolved from the anode with $S^{2-}$ yielded by the decomposition of thiocyanic acid. It would be more pertinent based on such disclosure to refer to the Corvet method as the sulfide depositing method rather than the sulfur permeation method. Since the iron dissolves from the anode, its surface is disadvantageously roughened. The iron oxide and sulfide suspend and gradually accumulate in the bath. Under such circumstance of suspension and accumulation, the proportion of iron oxide to the iron sulfide in the sulfurizing layer varies. This necessitates installation of a facility for removing the suspended materials from the bath and also to control the content of suspended materials in the bath. A pollution problem arises due to the free cyano compound as in the reducing molten salt method.

The sulfurizing layer formed by the Corvet method is from 5 to 10 $\mu$m thick and hence is thick. In the present specification, FeS and $Fe_{1-x}S$ formed by the Corvet method is not identified by the X-ray analysis method. The sulfurizing layer is allegedlly composed of FeS, $FeS_2$ and FeO. Also, the wear resistance decreases with the increase in FeS content to 30% or less.

The present inventors carried out fluorescent X-ray analysis of the above described sulfurizing and nitriding method and the electrolysis method by using a tester mentioned in the Example, for the purpose of investigating the quantity of iron sulfide in the sulfurizing layer. The result of sulfur (S)-count measurement is shown in Table 1.

TABLE 1

| | Sulfurizing and Nitriding Methods | | | Sulfurizing Method |
|---|---|---|---|---|
| | Molten Salt Method | Gas Method | Ionic Method | Electrolysis Method |
| S Count Number (kcps) | 1 or less | 5 or less | 5 or less | 17 or less |

Since the range of thickness of a layer capable of analysis by fluorescent X ray is from approximately 0 to 10 $\mu$m, this analysis is not highly accurate for measuring the S count number of a sulfurizing layer of 10 $\mu$m or more thickness. This analysis is, however, a relatively simple and easy method for indirectly determining the quantity of iron sulfide in the above sulfurizing layers. As a result of the analysis, it turned out that the amount of iron sulfide in terms of the S count is approximately 20 kcps or less, which is said to be considerably low.

The sulfurizing and nitriding methods and the sulfurizing method of the carburized or nitrided parts are broadly applied for the surface treatment of wear-resistant sliding parts made of general constructional steels, tool steels and the like. The parts treated by these methods are resistant against seizure, scoring wear and pitching wear under high pressure. The sulfurizing layer formed by any one of these methods has a thickness of more than 5 $\mu$m. This involves a problem, when applied to precision parts, because the dimensional accuracy is lessened.

The amount of iron sulfide in the sulfurizing layer formed by the sulfurizing and nitriding methods is as small as one third or less of that of the electrolytic sulfurizing method of the surface hardened material.

The surface roughness of the nitrided and then sulfurized material and surface-hardened and then electrolytically sulfurized material reflects that of the material prior to the sulfurization. The latter surface roughness, in turn, reflects that of material prior to the nitriding or surface hardening. Therefore, it is not yet clarified in the prior art to what extent the iron sulfide in the sulfurizing layer contributes to the wear resistance.

SUMMARY OF INVENTION

It is an object of the present invention to provide a surface treating method for enhancing wear resistance by means of cathodically depositing a sulfurizing layer on carbon steels for alloy steels, special steels and iron-based forgings and castings and, more particularly hardening heat-treated iron-based sliding parts, such as by carburizing, nitriding and induction heating.

It is an object of the present invention to provide an iron-based material having a sulfurizing layer with improved wear resistance.

The surface treating method according to the present invention is related to an electrolytic method for depositing a sulfurizing layer on a cathode. In the present invention, the sulfide is deposited on a cathode from an alkaline aqueous solution which contains ferric ions, a chelating agent of ferric ions and a sulfur compound. Features of the so formed sulfurizing layer are, first, that the amount of sulfide in the sulfurizing layer can be optionally controlled by electrolysis conditions such as current density and treatment temperature and time. Next, the sulfur (S) count numbers measured by fluorescent X-ray analysis of the sulfurizing layer is kept at 30 kcps or more, that is, twice or more as high as the conventional one, even if the sulfurizing layer is 5 $\mu$m or less thick. In addition, crystals deposited in the sulfurizing layer are fine. Although surface roughness of the sulfurizing layer is influenced by the surface roughness of the material prior to the electrolytic treatment, since the sulfurizing layer is finally crystalline, no appreciable change in roughness is detected due to the electrolytic treatment.

When the carburized material is to be sulfurized, surface oxide on the carburized surface should be preliminarily removed by a chemical or physical method. The surface roughness of such carburized and the sulfurized layer is dependent mainly on that formed by the chemical or physical method and practically not on the electrolytic condition.

When the nitrided material is to be sulfurized, it may be directly sulfurized or its surface may be preliminarily controlled by, for example, blasting the reduced iron powder. The surface roughness of such nitrided and then sulfurized layer is dependent on that of a compound layer present on the nitrided layer or on the controlled roughness.

In accordance with the present invention, there is provided a method for forming a wear-resistant layer, which is mainly composed of iron sulfide, and in which iron oxide is mixed, comprising:

preparing an alkaline electrolytic solution, which contains ferric ions, a first chelating agent for chelating the ferric ions and a sulfur compound, and which has a pH of 9 or more;

dipping a workpiece as a cathode in the alkaline electrolytic solution; and, carrying out electrolysis in the alkaline electrolytic solution, thereby depositing the wear resistant layer on the cathode.

There is also proposed by the present invention a wear-resistant layer having a 5 μm or less thick layer thereon produced by the method described above.

In an embodiment of the present according to the present invention, the alkaline electrolytic solution further contains a second chelating agent for chelating ferrous ions. In this embodiment, the deposition of iron oxide is furthermore suppressed. The sulfur (S) count number measured by fluorescent X-ray analysis of the sulfurizing layer is kept at 40 kcps or more, even if the sulfurizing layer is 3 μm or less thick. The sulfurizing layer is furthermore uniform and exhibits higher adhesion property.

According to the above mentioned embodiment, the alkaline electrolytic solution further contains a second chelating agent for chelating the ferrous ions, having at least one selected from the group consisting of $NH_3$ and NO, and also having a stability constant of the ferrous chelate compound lower than the stability constant of the ferric chelate compound formed by the first chelating agent.

In wear tests carried out by the present inventors, the surface roughness of material was varied before the electrolysis. Several materials in the form of a disk were merely carburized or nitrided. Other materials in the form of a disk were carburized or nitrided and then sulfurized. These materials were combined with the opposite material, i.e., a ball made of bearing steel, and were tested in a ball-on-disk tester under the dry condition (no lubrication). As a result of the tests, it was confirmed that, although the wear amount of the disks varies depending upon the heat treatment of the materials and is significantly influenced by the surface roughness of the materials prior to the electrolysis, the wear resistance of the sulfurized materials is better than that of the only carburized or nitrided materials, and further, the wear amount of the disks and ball decreases considerably with the increase in the S count number of iron sulfide in the sulfurizing layer. It was also confirmed that the wear amount of disks and ball is significantly influenced by the surface roughness of the materials prior to the electrolysis.

The present invention can be carried out in a dilute aqueous solution at a low temperature of 60° C. or lower. The energy cost involved in the inventive method can be greatly saved by 50% or more as compared with the known molten salt method. In addition, the carrying-over loss, i.e., loss of the reagents at the end of the treating process in the inventive method, can be saved by 50% or more as compared with the known molten salt method. Since the electrolyte composition of the present invention is free of cyano compounds which are toxic, a simple treatment method of waste liquor can be employed. The wear-resistant layer according to the present invention can be formed on any electro-conductive material. Industrially important materials are carbon steels for constructional use, alloy steels, special steels, iron-based castings and forgings, and the like. It is noteworthy to mention that the inventive surface treatment enables the sulfurizing layer to be deposited on the hardened surface by heat treatment, such as the carburized and nitrided surfaces, without softening the hardened surface.

Since the oxide layer, such as FeO and $Fe_3O_4$, is formed on the surface of the carburized material, it is inactive. Its surface must be activated by such pretreatments as chemical methods, for example, pickling with hydrochloric acid, sulfuric acid, sulfamic acid, hydrofluoric acid and the like, and anode electrolytic polishing method, as well as a physical method, for example shot, blasting and polishing, to remove the oxide layer and to activate the surface. These pretreatments can enhance the covering power of the electrolyte and the adhesion of the sulfurizing layer. No problem in the covering power and the adhesion is incurred in the case of a nitrided layer, even if the pretreatment is omitted. The nitrided material may, however, be pretreated physically by the shot-blasting, polishing and the like, when the appearance of deposited layer and the uniformity of surface roughness are to be improved.

The electrolyte composition according to the present invention contains the ferric ions, as the supplying source of the iron sulfide, and a first chelating agent which converts the ferric ions ($Fe^{3+}$) to a chelate compound of ferric ions. As a result, the formation of iron hydroxide, such as $Fe(OH)_3$ and $Fe(OH)_2$ from the ferric ions is prevented. That is, the ferric ions are stable in the alkaline solution and do not precipitate. Since the electrolytic solution is of pH 9 or more and of medium to strong alkalinity, the molar concentration of the chelating agent is preferably at least twice that of the ferric ions and is in the range of from 0.10 to 2.0 mol/L.

The molar concentration of the first chelating agent is more preferably at least three times that of the ferric ions and is in the range of from 0.18 to 1.8 mol/L.

The first chelating agent is preferably such that the stability constant of a chelate compound of ferric ions is higher than the stability constant of a chelate compound of ferrous ions, because the activity of $Fe^{2+}$ ions can be more easily controlled in a range of low reducing potential and the sulfide can be easily formed from the $Fe^{2+}$ ions than in a case where the latter stability constant is higher than the former stability constant.

Representative chelating agents of ferric ions, having the stability constant mentioned above are: aliphatic carboxylic acids such as citric acid, gluconic acid and tartaric acid; heptonic acids such as α-D-glucoheptonic acid, β-D-galacoheptonic acid, α-D-galacoheptonic acid and β-D-galacoheptonic acid; aromatic compounds such as 5-sulfosalicylic acid and pyrocatechol-3, 5-sulfonic acid; a derivative of aromatic compounds having an amino group such as amino-naphthol disulfonic acid, 3-aminophenol sulfonic acid and 4-aminophenol sulfonic acid; amino polycarboxylic acids such as ethylenediamine-N, N-diacetic acid, ethylenediaminetraacetic acid, N-hydroxylethylenediamine-N, N',N'-triacetic acid and N,N'-di(2-hydroxylbenzile) ethylenediamine-N, N'-diacetic acid; and a derivative of oxynes such as 8-oxyquinoline, oxyne-5-sulfonic acid, 7-iodoxine-5-sulfonic acid.

In an electrolytic solution according to the present invention, when the molar concentration of ferric ions is less than 0.05 mol/L, the deposition of the sulfurizing layer becomes difficult even under favorable electrolyzing conditions of high treatment temperature, long treatment time and high current density. As a result, the S count number of iron sulfide does not amount to 30 kcps. On the other hand, when the molar concentration of ferric ions is more than 0.5 mol/L, the S count number of iron sulfide amounts to 30 kcps or more, even under unfavorable electrolyzing conditions of low treatment temperature, short treatment time and low current density. However, a large amount of the deposited sulfurizing layer peels off during the subsequent washing step or the sulfurizing layer deposits in thickness of more than 5 μm. Preferably, the molar concentration of ferric ions in the electrolytic solution is in a range of from 0.1 to 0.45 mol/L. The molar concentration of ferric ions in the electrolytic solution is preferably low in a range of from 0.1 to 0.3 mol/L from the viewpoint of industrially depositing the sulfurizing layer, at low cost, and easily controlling the electrolytic operation.

The other supplying source of the sulfurizing layer is the sulfur compound. The sulfur can be supplied by dissolving such sulfides as $K_2S$, $Na_2S$ and $(NH_4)_2S$ or decomposing thiosulfate such as $K_2S_2O_3$, $Na_2S_2O_3$ and $(NH_4)_2S_2O_3$, dithionsulfate such as $K_2S_2O_4$, $Na_2S_2O_4$ and $(NH_4)_2S_2O_4$, and tetrathionsulfate such as $K_2S_4O_6$, $Na_2S_4O_6$ and $(NH_4)_2S_4O_6$. Preferably, the molar concentration of sulfides, thiosulfate and dithionsulfate in the electrolytic solution is from 1/10 to 20/10 times relative to the concentration of ferric ions and is in a range of from 0.005 to 1.0 mol/L. Preferably, the molar concentration of tetrathionsulfate in the electrolytic solution is from 1/20 to 10/10 times relative to the concentration of ferric ions and is in a range of from 0.0025 to 0.5 mol/L. When the molar concentration of sulfides, thiosulfate and dithionsulfate relative to the ferric ions is less than 1/10 times relative to the concentration of ferric ions and is less than 0.005 mol/L, the deposition of sulfurizing layer becomes difficult and the S count number of iron sulfide does not amount to 30 kcps, even under the favorable electrolytic conditions mentioned above. On the other hand, when the concentration of the sulfides, thiosulfate and dithionsulfate relative to the ferric ions is more than 20/10 times that of the concentration of ferric ions and is more than 1.0 mol/L, although the S count number of iron sulfide amounts to 30 kcps or more, the peeling and increase in thickness of the deposited sulfurizing layer described above arises. More preferably, the molar concentration of sulfides, thiosulfate and dithionsulfate in the electrolytic solution is from 1/5 to 16/10 times relative to the concentration of ferric ions and is in a range of from 0.01 to 0.8 mol/L.

Preferably, the molar concentration of tetrathionsulfate in the electrolytic solution is from 1/10 to 8/10 times relative to the concentration of ferric ions and is in a range of from 0.005 to 0.4 mol/L.

The pH value of the electrolytic solution is limited to 9 or more, because at pH more than 9, the S count number of iron sulfide is less than the level to be attained by an electrolytic condition which dominates the deposition of the sulfurizing layer, particularly the current density and the treatment time. When the pH value of the electrolytic solution is maintained at 13 or more, an alkaline compound such as potassium hydroxide and potassium ammonium should be supplied to the electrolytic solution. This is cumbersome and increases the treatment cost. A preferable pH is, therefore, in a range of from 10.0 to 12.0.

The sulfurizing layer, in which the sulfur (S) count number or iron sulfide is for example 30 kcps, is hereinafter simply referred to as the sulfurizing layer of 30 kcps.

The treatment temperature, which is one of the electrolytic conditions, is preferably 15° C. or higher, because at a temperature lower than 15° C., the electrolytic treatment must be carried out for longer than 1 hour in order to form the sulfurizing layer of 30 kcps or more. When the treatment temperature is 60° C. or higher, although the sulfurizing layer of 30 kcps or more can be formed at a treatment time of 3 minutes or less, such layer is prone to crack or may locally peel from a workpiece. A more preferable treatment temperature is from 25 to 50° C.

The current density, which is another electrolytic condition, is preferably 0.3 $A/dm^2$ or more, because at current density less than 0.3 $A/dm^2$ the electrolytic treatment must be carried out for longer than 1 hour in order to form the sulfurizing layer of 30 kcps or more. On the other hand, when the current density is more than 12 $A/dm^2$, although the sulfurizing layer of 30 kcps or more can be formed, such layer is prone to crack or may locally peel from a workpiece. A more preferable current density is from 0.5 to 10 $A/dm^2$.

When the electrolytic conditions are set within the preferable ranges mentioned above, that is, the current density, and the treatment time and temperature are optionally combined within such ranges, the sulfurizing layer of 30 kcps or more can be formed.

The electrolytic solution according to the present invention may further contain a sulfite, such as $K_2SO_3$, $Na_2SO_3$ and $(NH_4)_2SO_3$. The polysulfide such as $K_2S_x$, $Na_2S_x$ and $(NH_4)_2S_x$ may be yielded from the sulfur compounds mentioned above and float on the surface of the electrolytic solution. This polysulfide can be dissolved under the presence of the sulfite, while the electrolytic solution is stirred, with the result that the sulfur compound can be maintained at a constant level in the electrolytic solution. The molar concentration of sulfite is preferably 1/5 times or more relative to that of the sulfur compound and is 0.001 mol/L or more, because at a lower level the amount of floating polysulfide greatly increases to such a level that it cannot be dissolved by stirring of the electrolytic solution. The undissolved polysulfide must, therefore, be removed from the electrolytic solution by filtering, while the replenishing amount of the sulfur compound to the bath must be increased. On the other hand, the molar concentration of sulfite is preferably 1/1 times or less relative to that of the sulfur compound and is 1.0 mol/L or less, because at a higher level, although the generation of polysulfide can be suppressed, the deposition of the sulfurizing layer becomes difficult and the S count number does not reach 30 kcps even under the favorable electrolytic conditions mentioned above. More preferably, the molar concentration of sulfite is from 2/5 to 4/5 times or less relative to that of the sulfur compound and is from 0.002 to 0.8 mol/L.

According to a preferred embodiment of the present invention, the second chelating agent for converting the ferrous ions to a ferrous chelate compound has in its structure at least one group of amine ($NH_3$) and nitro ($NO_2$) group. The second chelating agent of ferrous compound can readily covert the ferrous ions, which undergo the oxidizing reaction, to a chelate compound, thereby suppressing the deposition of the ferrous ions as the iron oxide in the sulfurizing layer. As a result, the sulfurizing layer formed by this embodiment can have 40 kcps or more; have thickness of 3 $\mu$m or less and be very thin; be uniform; and so adhesive on the workpiece that it does not peel under the bonding and peeling test of an adhesive tape.

The second chelating agent of the ferrous ions is preferably such that the stability constant of a chelate compound of ferrous ions is lower than the stability constant of a chelate compound of ferric ions, because, if the former stability constant is higher than the latter stability constant, the chelating agent is not very effective for suppressing the deposition of iron oxide in the sulfurizing layer, when the chelate compound of a ferrous compound has accumulated in the electrolytic solution.

The molar concentration of a chelating agent of the ferrous ions exerts a great influence upon the adhesion of the sulfurizing layer on a workpiece. The molar concentration of chelating agent of ferrous ions is preferably 1/10 times or more relative to the concentration of ferric ions and is 0.005 mol/L or more, because at a lower level the adhesion of the sulfurizing layer is as low as that formed in the electrolytic solution without the chelating agent of ferrous ions. On the other hand, the molar concentration of a chelating agent of ferrous ions is preferably 16/10 times or less relative to the concentration of ferric ions and is 0.8 mol/L or less, because at a higher level a considerable proportion of the ferrous ions reduced from the ferric ions remains as the ferrous chelate compound, with the result that the amount of ferrous ions supplied to the sulfurizing layer becomes deficient. The sulfurizing layer so deposited is porous so that it peels off while the workpiece is subsequently washed. More preferably, the molar concentration of a chelating agent of ferrous ions is from 3/10 to 14/10 times relative to the concentration of ferric ions and is from 0.015 to 0.7 mol/L.

The kinds of the chelating agent of the ferrous ions are classified into the water-soluble type and the solvent-soluble-type, such as soluble in ethanol. The latter type of chelating agent is not easy to use, because it is necessary to grasp its solubility in a solvent and the electrolytic solution and the vaporization behalvior of the solvent from the electrolytic solution.

Representative water-soluble chelating agents having amine in the structure are, for example the following organic compounds; a derivative of aromatic compounds such as m-aminophenol, 3-aminobenzenesulfonic acid, 3-amino-4-hydroxybenzenesulfonic acid, 3-amino-4-metoxybenzenesulfonic acid, 4-amino-3-methylbenzenesulfonic acid, aminophenoldisulfonic acid, 1-amino-2-naphthol-4-sulfonic acid and 4-amino-3-hydroxy-1-naphthol-sulfonic acid; aminocarboxylic acids such as aminophthalic acid, aminosalcylic acid, 5-amino-2-hydroxylaromatic acid, 2-aminothiazole-4-carboxylic acid and 2-amino-3-pyridinecarboxylic acid; a derivative of polycarboxylic acid having an amine group such as diethylenetriamine pentaacetic acid, mercaptoethyleneimino-amino-diacetic acid, and nitrilolyltriacetic acid.

Representative water-soluble chelating agents having nitro group in the structure are, for example, the following organic compounds: a derivative of aromatic compound having a nitro group such as nitrophenol sulfate, nitrothiophenol, 3nitrobenzenesulfonic acid, 6-nitro-2-aminophenol-4-sulfonic acid, nitrophthaline sulfonic acid, and 4, 4'-dinitrostilbene-2, 2'-disulfonic acid; carboxylic acids having nitro group such as 3-5-dinitrobenzonate, 2-hydroxy-3, 5-dinitrobenzonate, nitronaphthalic acid, nitroterephthalic acid and d-nitropropionic acid; and a derivative of nitro group compounds such as 8-hydroxy-5-nitropyridine and nitro-m-toluidine.

Representative solvent-soluble chelating agents being soluble in alcohol and the like, and having an amine group are: aminocarboxylic acids such as aminoisophthalic acid, amino-1-naphthoic acid and aspartic acid; a derivative of an aromatic compound having an amine group such as aminocresol, aminothiophenol and aminonitrophenol; and a derivative of oxines such as aminoquinoline and aminoquinadine.

Representative chelating agents being soluble in alcohol and the like and having a nitro group are: a derivative of aromatic compounds having nitro group such as nitro-1-naphthylamine, nitro-1-naphthol, nitrohydroquinone and 4-nitrotoluene-2-sulfonic acid; and, a derivative of carboxylic acids having a nitro group such as nitrophenylacetic acid and nitro-1-naphtoic acid.

A third chelating agent having amine ($NH_3$) and/or nitro ($NO_2$) group in the structure can be used in substitution for or in addition to the second chelating agent, so as to convert the ferrous ions to the chelate compound. Such ferrous chelate compound may be preliminarily present in the electrolytic solution. In such electrlolytic solution containing the ferric ions and the ferrous chelate compound, the deposition of iron oxide in the sulfurizing layer is suppressed. When the third chelating agent effectively suppresses such deposition, highly adhesive sulfurizing layer of 3 um or less thinness and 40 kcps or more can be formed under the electrolytic condition of low current density and short treating time. Preferably, the molar concentration of ferrous ions is from 1/10 to 5/10 times relative to the molar concentration of the ferric ions and is in a range of from 0.0025 to 0.25 mol/L. When the molar concentration of ferrous ions is less than 1/10 times relative to the molar concentration of the ferric ions and is less than 0.0025 mol/L, a proportion of the iron sulfide in the sulfurizing layer is not very high under the electrolytic condition of low current density and short treatment time. On the other hand, when the molar concentration of ferrous ions is more than 5/10 times relative to the molar concentration of the ferric ions and is more than 0.25 mol/L, the proportion of iron oxide in the sulfurizing layer is so increased that the increase in iron sulfide is suppressed. More preferably, the molar concentration of ferrous ions is from 2/10 to 4/10 times relative to the molar concentration of the ferric ions and is in a range of from 0.01 to 0.20 mol/L.

Since the inventive method falls within the plating method, common knowledge relative to the plating such as given below can be optionally employed without any hindrance to the inventive method. A salt such as potassium, sodium or ammonium sulfate, hydrochloride, pyrolinate and amidesulfonate having large solubility in the electrolytic solutions is added to the electrolytic solution. The additive amount may be 0.5 mol/L or more. The added salt acts as an electrolyte and brings about the following phenomenon. That is, the polarization curve of current density and voltage are made horizontal. Depolarization occurs. As a result of such phenomenon, the current density on the workpiece and hence thickness of the sulfurizing layer become uniform.

BRIEF DESCRIPTION OF DRAWINGS

FIG. 4(*b*) is an X-ray chart identifying the iron sulfides in the sulfurizing layer formed on the nitrided material.

Embodiments of the present invention are described furthermore with reference to the drawings.

Figure 1:
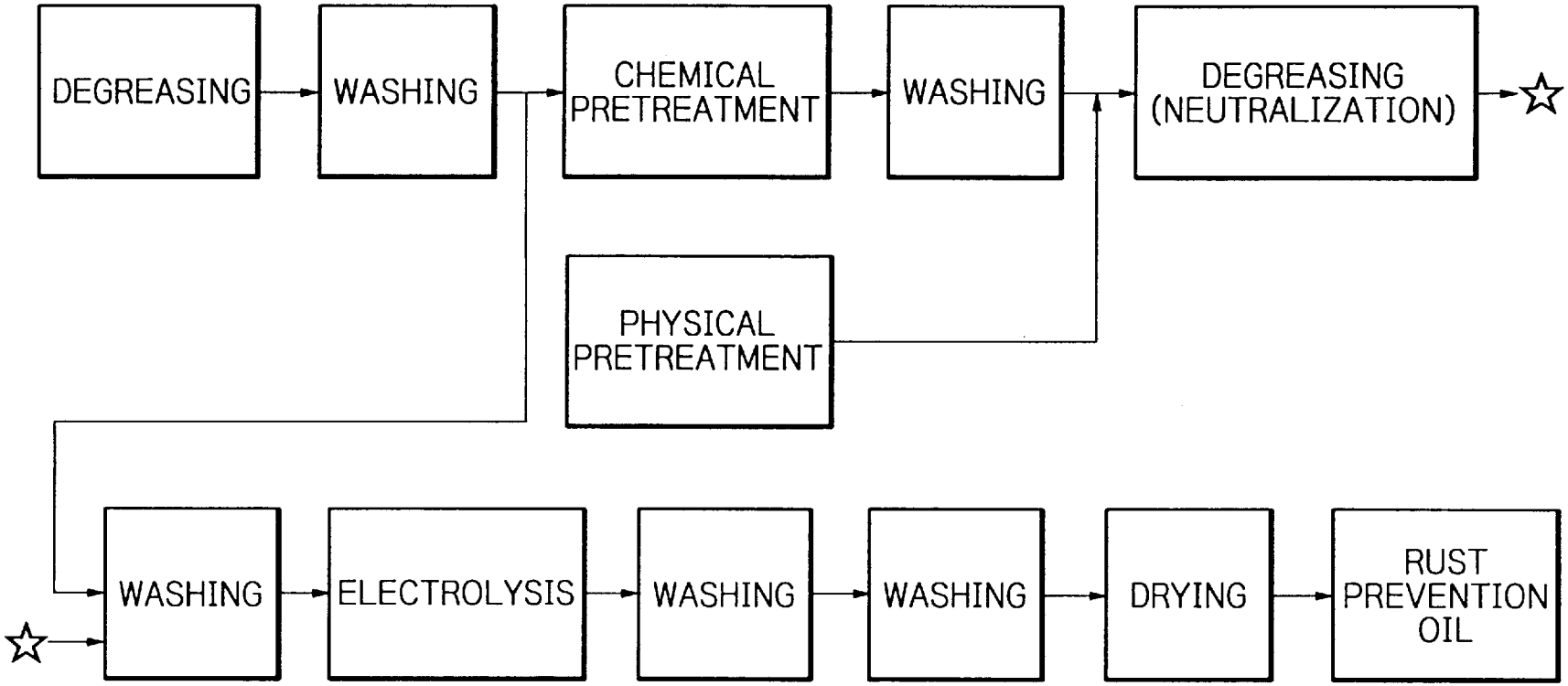
FIG. 1 is a flow chart for illustrating the electrolytic deposition method according to the present invention.

When industrially implementing the method according to the present invention, the treatments are performed following FIG. 1. That is, oil, dirt matter and the like, which are deposited on the parts such as carburized or nitrided materials, are removed by an alkaline degreasing agent and then washed with water. The carburized material is subjected to a chemical pretreatment to remove the oxide film, followed by water-washing or neutralizing degreasing and water-washing. Alternatively, the carburized material is subjected to a physical pretreatment to remove the oxide film, followed by degreasing to remove the abrasives and water-washing. The nitrided material may be physically pretreated to adjust the surface conditions, in a case where its appearance is unfavorable and its surface roughness is to be uniformized. In the other cases, the nitrided material is not pretreated.

Figure 2:
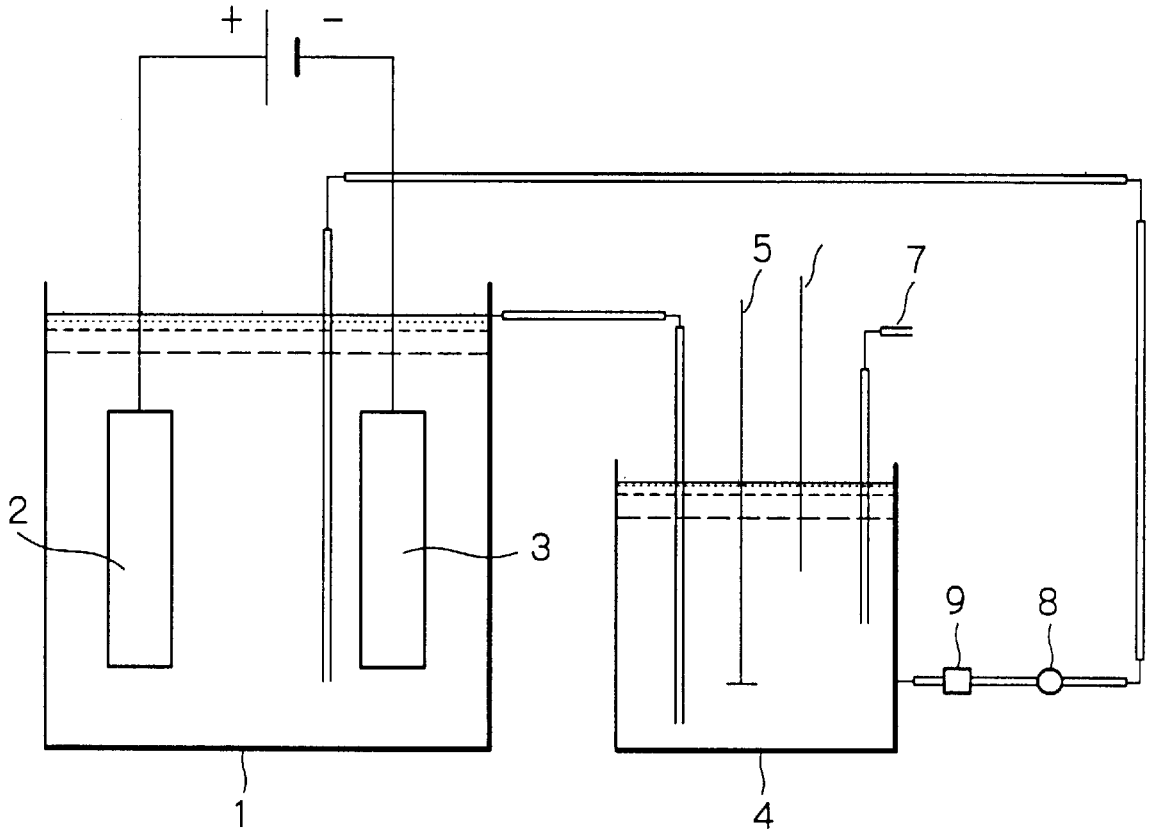
FIG. 2 is a schematic drawing showing an electrolytic deposition.

Following the last water-washing in the pretreating step, the workpiece is immersed in the electrolytic solution of the apparatus shown in FIG. 2 as a cathode, and the electrolytic deposition is carried out. In FIG. 2, the reference numerals denote the following members. 1—electrolytic tank, 2—anode, 3—cathode, 4—tank for replenishing reagents, 5—stirrer, 6—pH meter, 7—replenishing conduit, 8—pump, 9—filter, and 10—circulating conduit.

After water-washing, the workpiece is dried by hot air blast at 80–100° C. The surface treatment thus completes. The water-washing in two stages and subsequent application of rust-preventing oil can maintain the rust-prevention over an extended period of time.

EXAMPLES

The examples of the present invention are hereinafter described with reference to the examples.

Kinds of heat treatment were as follows.

Carburizing. Steel (SPCC under JIS designation) was liquid carburized (KCN+carbon molten-salt bath) at 870° C. for 0.5 hour and then heated at 800° C. for 5 minutes, followed by quenching (the carburized material)

Nitriding. Steel (SPCC under JIS designation) was treated in reducing molten-salt bath (trade name—tufftriding) at 570° C. for 1.5 hour (the nitrided material)

In Examples 1 through 8 only the first chelating agent was used. In Examples 9 and 10 the ferrous chelate compound was preliminarily added. In Examples 11 through 17, the relative molar concentration of sulfur compound was adjusted with respect to the ferric ions. In Example 18, the first and second chelating agents were used.

The compositions of the electrolytic solutions in Examples 1 through 10, such as the molar concentration of ferric ions, kinds and concentration of the first chelating agent, the sulfur compounds and nitrite, pH range, and kinds and molar concentration of the electrolyte are shown in Table 2-1.

When thickness of sulfurizing layer deposited from the electrolytic solutions according to Examples 1 through 10 is adjusted in a range of from 4 to 5 $\mu$m, the S count number of iron sulfide in the sulfurizing layer amounts to approximately 30 kcps. The electrolytic conditions (current density, and treatment temperature and time), the operability (generation of the polysulfide in the electrolytic solution and solution of polysulfide), and the deposition state of the sulfurizing layer (S count number of iron sulfide, thickness of layer, surface roughness and adhesion of adhesive tape (trade name—Cellotape) are shown in Tables 3-1.

The compositions of the electrolytic solutions in Examples 11 through 18, such as the molar concentration of ferric ions, kinds and concentration of the first and second chelating agents, the sulfur compounds and nitrite, pH range, and kinds and molar concentration of electrolytes are shown in Table 2-2.

When the thickness of sulfurizing layer deposited from the electrolytic solutions according to Examples 11 through 18 is adjusted in a range of from 2 to 3 $\mu$m, the S count number of iron sulfide in the sulfurizing layer amounts to approximately 40 kcps or more. The electrolytic conditions (current density, and treatment temperature and time), the operability (generation of polysulfide in the electrolytic solution and solution of polysulfide), and the deposition state of the sulfurizing layer (S count number of iron sulfide, thickness of layer, surface roughness and adhesion of adhesive tape (trade name—Cellotape) are shown in Tables 3-3.

Figure 4A:
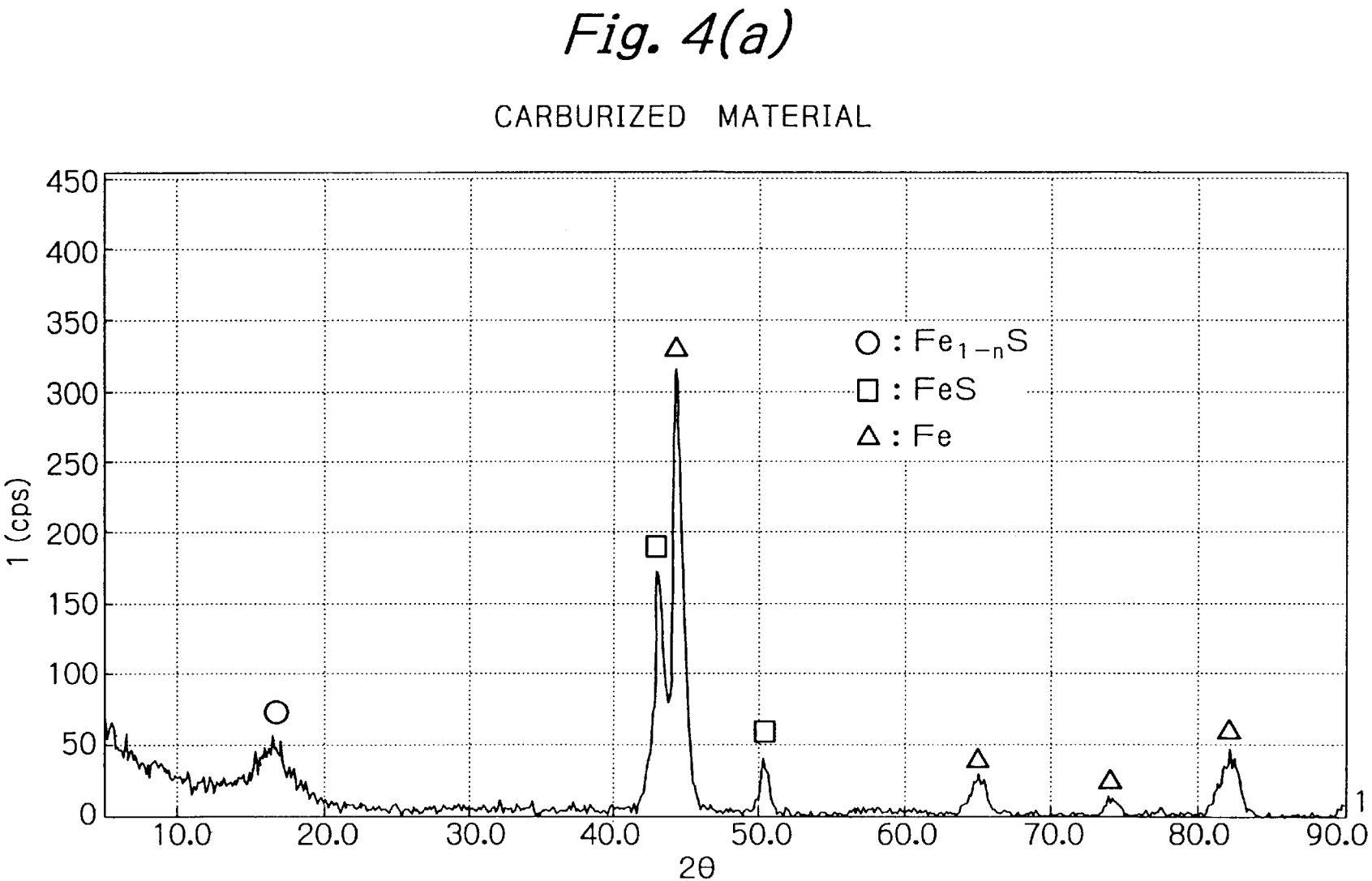
FIG. 4(*a*) is an X-ray chart identifying the iron sulfides in the sulfurizing layer formed on the carburized material.
Figure 4B:
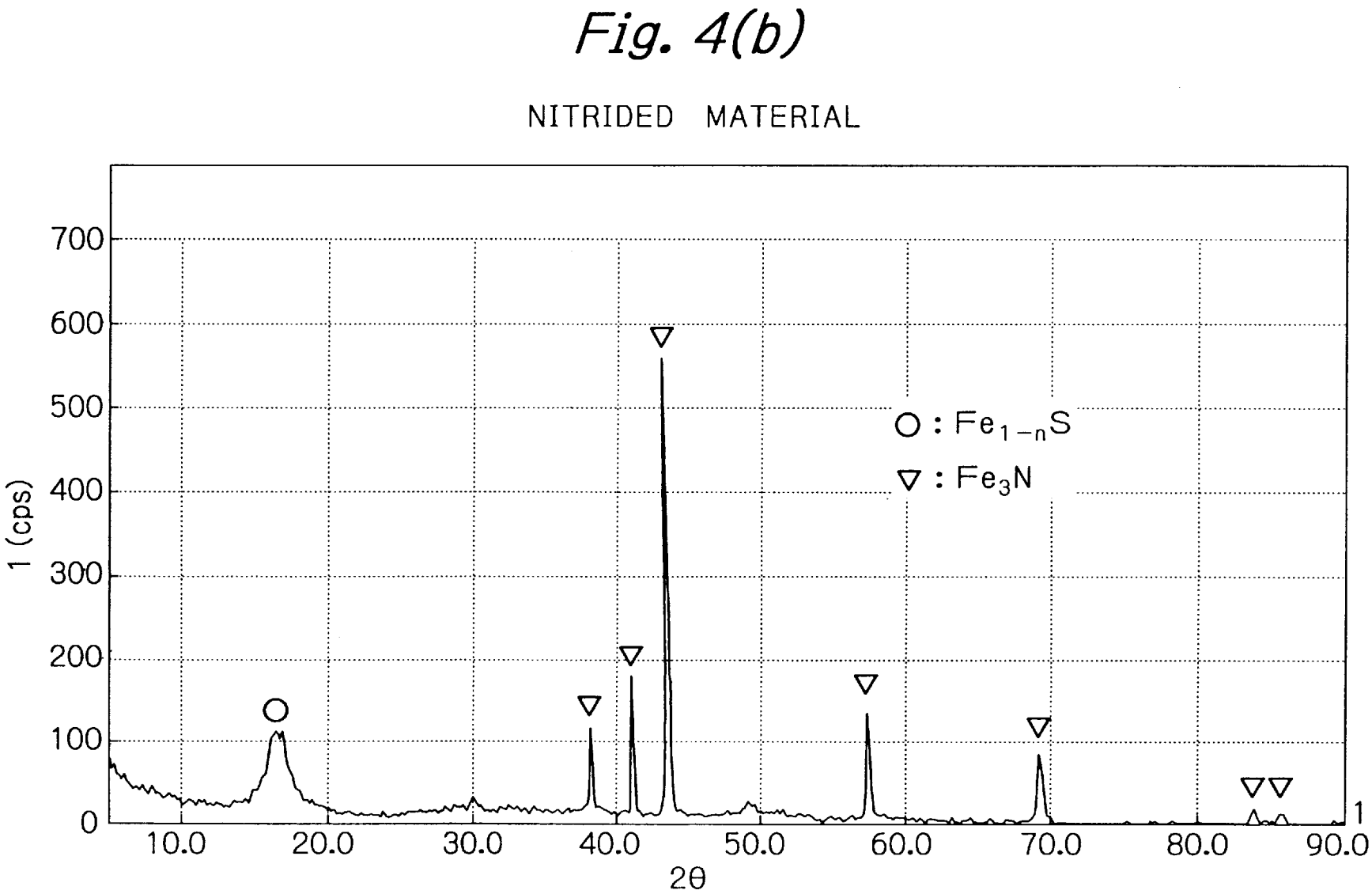

As shown in FIG. 4, the iron sulfides such as FeS and $Fe_{1-x}S$ were identified by the X-ray diffraction method in the sulfurizing layer.

Figure 3:
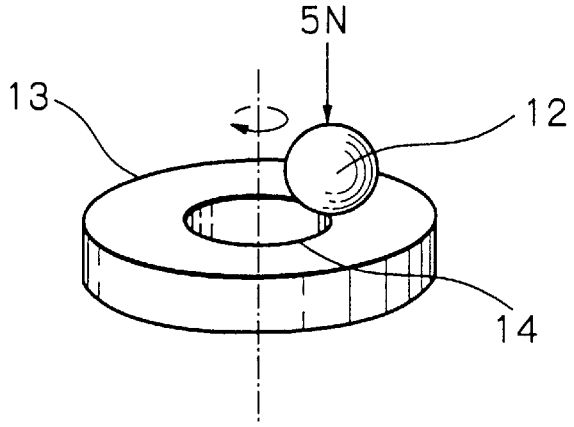
FIG. 3 is a schematic drawing showing a ball-on-disk tester used for investigating the wear resistance.

The disks of the carburized material, subjected to wear-resistance test using a ball-on-disk tester shown in FIG. 3, were pretreated in the chemical method by pickling with hydrochloric acid and the physical method by alumina-shots. Several disks of nitrided material, subjected to the wear-resistance test, were pretreated by the physical method by shots of reduced iron-powder so as to form various surface roughness, while the other disks were not pretreated. The pre-treated or non pretreated disks were subjected to the formation of a sulfurizing layer.

In Example 9, a thick sulfurizing layer was deposited. In Example 14, a thin sulfurizing layer was deposited. In Table 4-1 are shown the properties of the sulfurizing layer including its thickness, and wear amount of the disk and ball with respect to the carburized material. In Table 4-(2) are shown the same data as in Table 4-(1) with regard to the nitrided material.

The additional statements of the tables are given hereinafter.

1. Operability (State of Electrolytic Solution)
   (a) Operation Conditions (Current Density, Temperature and Time)
   The electrolytic solution was electrolyzed under the conditions of 3.0 A/dm$^2$ of current density, 30° C. and 120 minutes.
   (b) Judging Method
   The time, at which the polysulfide floats on the surface interface of the electrolytic solution, was recorded. After completion of the electrolysis, the electrolytic solution was stirred by a stirrer for 30 minutes, and, then the dissolving behavior of the polysulfide is recorded.
2. S Count Number of Sulfurizing Layer (Simplified Measuring Method of Iron Sulfide by Fluorescent X-ray)
   (a) Fluorescent X-ray Analyzing Device
   Product of Rigaku Denki Industries Co., Ltd. (System 3270)
   (b) Measuring Condition
   Tube—rhodium tube, tube voltage—50 kV, and tube current—50 mA
   (c) Sample for Standardization—standard samples provided by the manufacturer to use in adjusting the pulse-height analyzer
   (d) Measuring Method
   The carburized or nitrided and sulfurized specimens were tested on a measuring surface of 15 mm in diameter to detect the sulfur deposited on the measuring surface. The S count number (kcps) was recorded.
3. Thickness of the Sulfurizing Layer (Simplified Measurement of Layer Thickness by Electromagnetic Tester of Ultra thin Thickness)
   (a) Electromagnetic Tester of Thickness
   Product of Kett Science Research Institute (LZ-200W)
   (b) Zero-Point Calibration
   The carburized or nitrided and then pretreated material, each, was used for zero-point calibration.
   (c) Adjusting of Thickness
   On the zero-point calibrated sample, material of known thickness was placed to adjust the thickness.
   (d) Measuring Method
   Measurement was repeated twenty times in consideration of the fact that the surface conditions of the samples were locally varied. The larger and smaller values totalling five were omitted, and the middle five values were recorded.

4. Surface Roughness of Sulfurizing Layer (Measurement by Surface Roughness-Shape)

(a) Tester of Surface Roughness-Shape

Product of Tokyo Seimitsu Co., Ltd. (Surfcom 5700A)

(b) Measuring Method

Ten measurements (n=10) were carried out on the sulfurizing layer. The range of roughness (Ra) was recorded.

5. Adhesion of the Sulfurizing Layer (Contact Bonding of Adhesive Tape (Cellotape-trade name)

(a) Measuring Method

An adhesive tape was applied on the sulfurizing layer and a rod, the end of which was rounded, was rubbed over the adhesive tape. The adhesive tape was then peeled from the sulfurizing layer. The state of the sulfurizing layer adhered on the adhesive tape and the remaining state of the sulfurizing layer were evaluated.

(b) Evaluating Criterion

O: Trace adhesion on the adhesive tape. Negligible peeling of the sulfurizing layer.

Δ: Considerable adhesion on the adhesive tape. Appreciable peeling of the sulfurizing layer.

x: Serious adhesion of the sulfurizing layer. Almost all of the sulfurizing layer peels off.

6. Identification of Iron Sulfide in the Sulfurizing Layer (X-ray diffraction Method)

(a) X-ray Diffraction Device

Product of Mackseience ($MXP^{3A}$ HF Type)

(b) Measuring condition

X-ray Generating Device: 3 KW, target-Cu, tube voltage −40.0 kV, tube current −40.0 mA, and measuring angle (2θ)=0–90°

(c) Identification of Iron Sulfide Peaks were compared with the ASTH cards of FeS and $Fe_{1-X}S$, 7. Wear-Resistance of the Sulfurizing Layer (Testing Method of Wear)

(a) Testing Method of Wear

Ball-on-disk tester shown in FIG. 3 (Product of CSEM Co., Ltd. TRIBOMETER)

(b) Testing Condition

The ball 12 was pressed on the rotating disk 13 (30 mm in diameter and 0.7 mm of thickness) at a load of 5N and was caused to slide on a circle 14 of 12 mm in diameter at a speed of 314 mm/second and under the dry condition (without lubrication). The sliding distance was 376 meters.

(c) Material, Diameter and Hardness of Ball

SUJ 2, 6 mm in diameter, and Vickers Hardness (Hv) of 760–780

(d) Specification of Disk (Material and Hardness of Comparative Material, Material of Examples, and Depositing Condition of the Sulfurizing Layer)

Comparative Examples

Carburized Material—30 mm in diameter, and Vickers Hardness (Hv) of 700–730

Nitrided Material—30 mm in diameter, and Vickers Hardness (Hv) of 450–500

EXAMPLES (1) Deposition of a thick sulfurizing layer (5 μm or less). The carburized and nitrided materials were subjected to treatment using the electrolytic solution of Example 9. The electrolytic conditions were adjusted in such a manner as to provide from 10 to 30 kcps of S count number of the sulfurizing layer.

(2) Deposition of a thin sulfurizing layer (3 μm or less). The carburized and nitrided materials were subjected to the treatment using the electrolytic solution of Example 14. The electrolytic conditions were adjusted in such a manner as to provide from 10 to 50 kcps of S count number of the sulfurizing layer.

(e) Wear Amount of Ball

After the end of the test, the diameter of worn trace of the ball was measured by a microscope. The wear amount was calculated by the following equations. The equation for calculating the height (h) of worn trace from diameter of worn trace.

$$h=\tfrac{1}{2}d-(\tfrac{1}{2}\cdot d)^2-(\tfrac{1}{2}r)^2$$

The equation for calculating the worn volume ($V:mm^3$) from the height (h) of the worn trace.

$$V=\tfrac{1}{3}\cdot\pi\cdot h^2\cdot(3\times d-h)$$

The diameter of the ball is denoted by "d" (mm), and the radius of worn trace is denoted by "r" (mm).

(f) Wear Amount of Disk

After the end of test, the width and height of worn trace is measured by the tester of surface-roughness shape. The wear amount was calculated by the following equation.

Equation for calculating the wear amount ($v:mm^3$) from the width (K, mm) and width (H, mm) of worn trace.

$$v=(\pi\cdot R\cdot K\cdot H)/100000$$

The sliding circle is denoted by R (mm).

In Examples 1 through 8, the thickness of the sulfurizing layer is from 4 to 5 μm, and the S count number of iron sulfide in the sulfurizing layer is 30 kcps or more. The surface roughness of the sulfurizing layer is not different from that of carburized and nitride materials. The adhesion of the sulfurizing layer is Δ. Since the polysulfide was formed after 20 minutes, the operation was unsatisfactory. The polysulfide could not be dissolved by stirring.

In Examples 9 and 10, the thickness of the sulfurizing layer is from 4 to 5 μm, and the S count number of iron sulfide in the sulfurizing layer is 30 kcps or more. The surface roughness of sulfurizing layer is not different from that of carburized and nitride materials. The adhesion of the sulfurizing layer is Δ. Formation of the polysulfide was suppressed due to the sulfite. The operation was, therefore, satisfactory.

In Examples 11 through 17, the oxide deposition in the sulfurizing layer decreases. Although the thickness of sulfurizing layer is as thin as from 2 to 3 μm, and the S count number of iron sulfide in the sulfurizing layer is 40 kcps or more. The adhesion of the sulfurizing layer is improved.

In Examples 18 and 19, the electrolytic conditions are that current density is low and treatment time is short. The thickness of the sulfurizing layer is as thin as from 2 to 3 μm, and the S count number of iron sulfide in the sulfurizing layer is 40 kcps or more. The adhesion of the sulfurizing layer is improved as well.

As a result of the ball-on-disk type tester, it turns out that the wear amount of the opposite material, i.e., the ball, is greatly influenced by the surface roughness of the disk, which roughness varies by different pretreating methods for removing the oxide layer on the carburized layer, that is, 0.8 to 1.0 μm of surface roughness in the case of the chemical pretreating method (hydrochloric-acid pickling), and 0.9 to 1.2 μm of surface roughness in the case of physical pretreating method (alumina-shot). Wear amount of the disk in the case of physical pretreating is approximately twice as high as that in the case of chemical pretreating method. It is noted that the surface of the disk is rougher in the latter case than the former case.

Although the comparative nitrided material is pretreated by several methods to provide various surface roughnesses, the wear amount of the disk and ball was only slightly influenced by the difference in the surface roughness.

In Example 9, the wear amount of both carburized and nitrided materials (disks), which are then sulfurized to form a thick sulfurizing layer, as well as the wear amount of the ball decrease with the increase in the S count number. In addition, such wear amount is less than in the case of the comparative carburized and nitrided materials.

The surface roughness of pretreatment of the carburized and then thickly sulfurized material exerts an appreciable influence upon the wear as follows. In the case of the sulfurizing layer of 30 kcps and physical pretreatment, the wear amount of the ball is three times or more as high as that of the surfurizing of 30 kcps and chemical pretreatment.

The wear amount of nitrided and then thickly sulfurized, 30 kcps material (disk) is approximately the same as that of the comparative carburized material (disk). The wear amount of the opposite material (ball), which was caused to slide on the nitrided and then thickly sulfurized material (disk) of 30 kcps is approximately half of that caused to slide on the comparative carburized material (disk).

In Example 14, the wear of the ball, which is the opposite material of the carburized and then thinly sulfurized material, decreases with the increase in the S count number of the latter material. When the S count number of the sulfurizing layer amounts to 30 kcps or more, the wear amount of the ball is decreased to such a low level that various pretreating methods of the carburized material exert very slight influence on the wear of the ball. In addition, the wear of the ball, which is the opposite material of the nitrided and then thinly sulfurized material, decreases with the increase in the S count number of the latter material. When the S count number of the sulfurizing layer amounts to 30 kcps or more, the wear amount of ball is decreased to a low level.

As is described in detail hereinabove, the achievements provided by the present invention include the following.

(1) Iron sulfide is identified even in a thin sulfurizing layer as thin as 5 $\mu$m or less.

(2) It is clarified that the amount of iron sulfide, which is quantitatively determined by the simplified fluorescent X-ray method, has a relationship with the wear amount. It is clear that the iron sulfide is effective for improving the wear resistance.

(3) The carburized or nitrided and then thinly (3 $\mu$m or less) sulfurized material of 30 kcps or more can eliminate influence of the surface roughness of material prior to sulfurizing upon the wear amount.

(4) The sulfurizing layer is well uniform.

(5) The sulfurizing layer is well adhesive.

(6) The method according to the present invention can be applied to the parts which are required to have high dimensional accuracy.

(7) Although the wear test under the dry condition is described, the wear resistance under the lubricating condition is improved by the present invention as compared with the conventional methods.

TABLE 2-1

| Example | Conc. of $Fe^{3+}$ (mol/L) | Kind and conc. of $Fe^{3+}$ - Cheleting Agent (mol/L) | Kind and conc. of S-compound (mol/L) | Kind and pH conc. of sulfite (mol/L) | | Kind and conc. of Electrolyte (mol/L) |
|---|---|---|---|---|---|---|
| 1 | 0.2 | 5-sulfosalicylic acid 0.6 | potassium thiosulfate 0.08 | — | 11.0 | sodium sulfate 0.5 |
| 2 | 0.2 | oxine-5-sulfonic acid 0.6 | potassium thiosulfate 0.08 | — | 11.0 | sodium sulfate 0.5 |
| 3 | 0.2 | α-D-gulcoheptonic acid 0.6 | potassium thiosulfate 0.08 | — | 9.0–13.0 | sodium sulfate 0.5 |
| 4 | 0.2 | α-D-gulcoheptonic acid 0.4 | potassium thiosulfate 0.08 | — | 11.0 | sodium sulfate 0.5 |
| 5 | 0.1 | α-D-gulcoheptonic acid 0.3 | potassium thiosulfate 0.04 | — | 11.0 | sodium sulfate 0.5 |
| 6 | 0.3 | α-D-gulcoheptonic acid 0.9 | potassium thiosulfate 0.12 | — | 11.0 | sodium sulfate 0.5 |
| 7 | 0.4 | α-D-gulcoheptonic acid 1.2 | potassium thiosulfate 0.16 | — | 11.0 | sodium sulfate 0.5 |
| 8 | 0.2 | α-D-gulcoheptonic acid 0.6 | sodium sulfide 0.04 | — | 11.0 | sodium sulfate 0.5 |
| 9 | 0.2 | α-D-gulcoheptonic acid 0.6–0.16 | potassium thiosulfate 0.16 | 0.02 | 11.0 | sodium sulfate 0.5 |
| 10 | 0.2 | α-D-gulcoheptonic acid 0.6 | sodium sulfide 0.06 – 0.10 | 0.04 | 11.0 | sodium sulfate 0.5 |

TABLE 2-2

| Example | Conc. of $Fe^{3+}$ (mol/L) | Kind and conc. of $Fe^{3+}$ - chelating Agent (mos/L) | Kind and conc. of S-compound (mol/L) | Kind and conc. of sulfite (mol/L) | Kind and conc. of $Fe^{2+}$ - Chelating Agent (mol/L) | Conc. of $Fe^{2+}$ (mol/L) | pH | Kind and conc. of electro-lyte (mol/L) |
|---|---|---|---|---|---|---|---|---|
| 11 | 0.2 | α-D-gluco-heptonic acid 0.6 | potassium thiosulfate 0.16 | 0.08 | 3-amino-4-hydroxylbenzen-sulfonic acid 0.2 | — | 11.0 | ammonium sulfate 0.7 |
| 12 | 0.2 | α-D-gluco-heptonic acid 0.6 | potassium thiosulfate 0.16 | 0.08 | diethylenetriamine pentaacetic acid 0.4 | — | 11.0 | ammonium sulfate 0.7 |
| 13 | 0.2 | α-D-gluco-heptonic acid 0.6 | sodium sulfide 0.20 | 0.10 | 3-nitrobenzene-sulfonic acid 0.3 | — | 11.0 | sodium sulfate 0.7 |
| 14 | 0.2 | α-D-gluco-heptonic acid 0.6 | sodium sulfide 0.20 | 0.08 | 6-nitro-2-aminophenol-4-sulfonic acid 0.2 | — | 11.0 | sodium sulfate 0.7 |
| 15 | 0.2 | α-D-gluco-heptonic acid 0.6 | potassium thiosulfate 0.40 | 0.10 | 3-aminobenzene-sulfonic acid + 3-nitrobenzene-sulfonic acid 0.1 + 0.1 | — | 11.0 | potassium pyrosulfate 0.7 |
| 16 | 0.2 | α-D-gluco-heptonic acid 0.6 | patassium thiosulfate 0.26 | 0.10 | ethanol + aminoquinoline 0.5 + 0.2 | — | 11.0 | ammonium sulfate 0.5 |
| 17 | 0.2 | α-D-gluco-heptonic acid 0.6 | patassium thiosulfate 0.30 | 0.08 | ethanol + nitronaphthol 0.5 + 0.3 | — | 11.0 | ammonium sulfate 0.7 |
| 18 | 0.2 | α-D-gluco-heptonic acid 0.6 | sodium sulfide 0.20 | 0.06 | 3-nitrobenzene-sulfonic acid 0.2 | 0.10 | 11.0 | ammonium sulfate 0.7 |
| 19 | 0.2 | α-D-gluco-heptonic acid 0.6 | sodium sulfide 0.24 | 0.06 | 6-nitro-2-aminophenol-4-sulfonic acid + 3-aminobenzene-sulfonic aicd 0.15 + 0.1 | 0.15 | 11.0 | ammonium sulfate 0.7 |

TABLE 3-1

| | Condi-tion | Reasons for Change of Electrolyte Composition, Conc. | Electrolytic condition: Current Density ($A/dm^2$) | Electrolytic condition: Tempera-ture (° C.) | Electrolytic condition: Time (min) | Opera-bility Genera-tion and Solution of Poly-Sulfide | Kind of Heat Treat-ment | Depostion State of Sulfurizing Layer: S count Number (Kcps) | Depostion State of Sulfurizing Layer: Thick-ness of Layer (μm) | Depostion State of Sulfurizing Layer: Surface Rough-ness (μm) | Depostion State of Sulfurizing Layer: Adhesion (tape bonding) |
|---|---|---|---|---|---|---|---|---|---|---|---|
| Compara-tive | — | — | — | — | — | — | Carburi-zing | — | — | 0.8–1.0 | — |
| | | | | | | | Nitri-ding | — | — | 0.9–1.5 | — |
| Example 1 | 1-1 | 5-sulfosali-cylic acid used for chelating $Fe^{3+}$ | 2.0 | 40 | 25 | Genera-tion after 20 min. Solution impossible | Carburi-zing | 32.6 | 4–5 | 0.8–1.0 | Δ |
| | | | | | | | Nitri-ding | 31.9 | 4–5 | 0.9–1.5 | Δ |
| Example 2 | 2-1 | oxyne-5-sulfo-nic acid used for chelating $Fe^{3+}$ | 2.0 | 40 | 25 | Genera-tion after 20 min. Solution impossible | Carburi-zing | 35.1 | 4–5 | 0.8–1.0 | Δ |
| | | | | | | | Nitri-ding | 32.8 | 4–5 | 0.9–1.5 | Δ |
| Example 3 | 3-1 | α-D-glucohepto-nic acid used for chelating $Fe^{3+}$ pH = 9.0 | 2.0 | 30 | 25 | Genera-tion after 20 min. Solution impossible | Carburi-zing | 31.8 | 4–5 | 0.8–1.0 | Δ |
| | | | | | | | Nitri-ding | 30.7 | 4–5 | 0.9–1.5 | Δ |

TABLE 3-1-continued

| | Condition | Reasons for Change of Electrolyte Composition, Conc. | Electrolytic condition: Current Density ($A/dm^2$) | Electrolytic condition: Temperature (° C.) | Electrolytic condition: Time (min) | Operability Generation and Solution of Polysulfide | Kind of Heat Treatment | Depostion State of Sulfurizing Layer: S count Number (Kcps) | Depostion State of Sulfurizing Layer: Thickness of Layer (μm) | Depostion State of Sulfurizing Layer: Surface Roughness (μm) | Depostion State of Sulfurizing Layer: Adhesion (tape bonding) |
|---|---|---|---|---|---|---|---|---|---|---|---|
| Example 3 | 3-2 | αD-glucoheptonic acid used for chelating $Fe^{3+}$ pH = 11.0 | 2.0 | 30 | 25 | Generation after 20 min. Solution impossible | Carburizing | 31.4 | 4–5 | 0.8–1.0 | Δ |
| | | | | | | | Nitriding | 31.2 | 4–5 | 0.9–1.5 | Δ |
| Example 3 | 3-3 | α-D-glucoheptonic acid used for chelating $Fe^{3+}$ pH = 13.0 | 2.0 | 30 | 25 | Generation after 20 min. Solution impossible | Carburizing | 32.7 | 4–5 | 0.8–1.0 | Δ |
| | | | | | | | Nitriding | 33.1 | 4–5 | 0.9–1.5 | Δ |
| Example 4 | 4-1 | Molar Ratio of $Fe^{3+}$/chelating agent = 1/2 | 2.0 | 30 | 20 | Generation after 20 min. Solution impossible | Carburizing | 35.4 | 4–5 | 0.8–1.0 | Δ |
| | | | | | | | Nitriding | 36.2 | 4–5 | 0.9–1.5 | Δ |
| Example 5 | 5-1 | Low $Fe^{3+}$ conc. = 0.1 mol | 2.0 | 40 | 35 | Generation after 20 min. Solution impossible | Carburizing | 32.3 | 4–5 | 0.8–1.0 | Δ |
| | | | | | | | Nitriding | 31.5 | 4–5 | 0.9–1.5 | Δ |
| Example 6 | 6-1 | High $Fe^{3+}$ conc. = 0.3 mol | 2.0 | 30 | 25 | Generation after 20 min. Solution impossible | Carburizing | 35.3 | 4–5 | 0.8–1.0 | Δ |
| | | | | | | | Nitriding | 34.1 | 4–5 | 0.9–1.5 | Δ |
| Example 7 | 7-1 | High $Fe^{3+}$ conc. = 0.4 mol | 2.0 | 30 | 20 | Generation after 20 min. Solution impossible | Carburizing | 37.5 | 4–5 | 0.8–1.0 | Δ |
| | | | | | | | Nitriding | 38.4 | 4–5 | 0.9–1.5 | Δ |

TABLE 3-2

| | Condition | Reasons for Change of Electrolyte Composition, Conc. | Electrolytic condition: Current Density ($A/dm^2$) | Electrolytic condition: Temperature (° C.) | Electrolytic condition: Time (min) | Operability Generation and Solution of Polysulfide | Kind of Heat Treatment | Depostion State of Sulfurizing Layer: S count Number (Kcps) | Depostion State of Sulfurizing Layer: Thickness of Layer (μm) | Depostion State of Sulfurizing Layer: Surface Roughness (μm) | Depostion State of Sulfurizing Layer: Adhesion (tape bonding) |
|---|---|---|---|---|---|---|---|---|---|---|---|
| Example 8 | 8-1 | Thiosulfate was replaced with sulfide. Molar conc. of sulfide = 0.04 | 2.0 | 40 | 30 | Generation after 20 min. Solution impossible | Carburizing | 34.1 | 4–5 | 0.8–1.0 | |
| | | | | | | | Nitriding | 34.8 | 4–5 | 0.9–1.5 | |
| Example 9 | 9-1 | Sulfite added. Molar conc. of thiosulfate = 0.04 | 3.0 | 40 | 25 | No generation for 2 hrs. | Carburizing | 30.3 | 4–5 | 0.8–1.0 | |
| | | | | | | | Nitriding | 30.6 | 4–5 | 0.9–1.5 | |
| Example 9 | 9-2 | Sulfite added. Molar conc. of thiosulfate = 0.10 | 2.0 | 30 | 25 | No generation for 2 hrs. | Carburizing | 33.8 | 4–5 | 0.8–1.0 | |
| | | | | | | | Nitriding | 32.1 | 4–5 | 0.9–1.5 | |

TABLE 3-2-continued

| | Condition | Reasons for Change of Electrolyte Composition, Conc. | Electrolytic condition: Current Density ($A/dm^2$) | Electrolytic condition: Temperature (° C.) | Electrolytic condition: Time (min) | Operability Generation and Solution of Polysulfide | Kind of Heat Treatment | Depostion State of Sulfurizing Layer: S count Number (Kcps) | Depostion State of Sulfurizing Layer: Thickness of Layer (μm) | Depostion State of Sulfurizing Layer: Surface Roughness (μm) | Depostion State of Sulfurizing Layer: Adhesion (tape bonding) |
|---|---|---|---|---|---|---|---|---|---|---|---|
| Example 9 | 9-3 | Sulfite added. Molar conc. of thiosulfate = 0.16 | 2.0 | 30 | 20 | Generation at 2 hrs. Solution possible | Carburizing | 36.4 | 4–5 | 0.8–1.0 | |
| | | | | | | | Nitriding | 38.2 | 4–5 | 0.9–1.5 | |
| Example 10 | 10-1 | Sulfite added. Molar conc. of sulfide = 0.06 | 2.0 | 30 | 25 | No generation for 2 hrs. | Carburizing | 33.7 | 4–5 | 0.8–1.0 | |
| | | | | | | | Nitriding | 31.8 | 4–5 | 0.9–1.5 | |
| Example 10 | 10-2 | Sulfite added. Molar conc. of sulfide = 0.10 | 2.0 | 30 | 20 | No generation for 2 hrs. | Carburizing | 35.4 | 4–5 | 0.8–1.0 | |
| | | | | | | | Nitriding | 34.2 | 4–5 | 0.9–1.5 | |

TABLE 3-3

| | Condition | Reasons for Change of Electrolyte Composition, Conc. | Electrolytic condition: Current Density ($A/dm^2$) | Electrolytic condition: Temperature (° C.) | Electrolytic condition: Time (min) | Operability Generation and Solution of Polysulfide | Kind of Heat Treatment | Depostion State of Sulfurizing Layer: S count Number (Kcps) | Depostion State of Sulfurizing Layer: Thickness of Layer (μm) | Depostion State of Sulfurizing Layer: Surface Roughness (μm) | Depostion State of Sulfurizing Layer: Adhesion (tape bonding) |
|---|---|---|---|---|---|---|---|---|---|---|---|
| Example 11 | 11-1 | 3-amino-4-hydroxybenzenesulfonic acid used for chelating $Fe^{2+}$ | 8.0 | 40 | 20 | No generation for 2 hrs. | Carburizing | 42.4 | 2–3 | 0.8–1.0 | ○ |
| | | | | | | | Nitriding | 45.0 | 2–3 | 0.9–1.5 | ○ |
| Example 12 | 12-1 | diethylenetriaminepentaacetic acid used for chelating $Fe^{2+}$ | 8.0 | 50 | 25 | No generation for 2 hrs. | Carburizing | 41.3 | 2–3 | 0.8–1.0 | ○ |
| | | | | | | | Nitriding | 40.8 | 2–3 | 0.9–1.5 | ○ |
| Example 13 | 13-1 | 3-nitrobenzenesulfonic acid used for chelating $Fe^{2+}$ | 5.0 | 50 | 25 | No generation for 2 hrs. | Carburizing | 44.7 | 2–3 | 0.8–1.0 | ○ |
| | | | | | | | Nitriding | 42.8 | 2–3 | 0.9–1.5 | ○ |
| Example 14 | 14-1 | 6-nitro-2-aminophenol-4-sulfonic acid used for chelating $Fe^{2+}$ | 5.0 | 50 | 20 | No generation for 2 hrs. | Carburizing | 40.7 | 2–3 | 0.8–1.0 | ○ |
| | | | | | | | Nitriding | 40.5 | 2–3 | 0.9–1.5 | ○ |
| Example 15 | 15-1 | 3-aminobenzenesulfonic acid + 6-nitro-2-aminophenol-4-sulfonic acid used for chelating $Fe^{2+}$ | 7.0 | 30 | 20 | No generation for 2 hrs | Carburizing | 40.9 | 2–3 | 0.8–1.0 | ○ |
| | | | | | | | Nitriding | 41.8 | 2–3 | 0.9–1.5 | ○ |

TABLE 3-3-continued

| | Condition | Reasons for Change of Electrolyte Composition, Conc. | Electrolytic condition: Current Density (A/dm$^2$) | Electrolytic condition: Temperature (° C.) | Electrolytic condition: Time (min) | Operability Generation and Solution of Poly-Sulfide | Kind of Heat Treatment | Depostion State of Sulfurizing Layer: S count Number (Kcps) | Depostion State of Sulfurizing Layer: Thickness of Layer (μm) | Depostion State of Sulfurizing Layer: Surface Roughness (μm) | Adhesion (tape bonding) |
|---|---|---|---|---|---|---|---|---|---|---|---|
| Example 16 | 16-1 | ethanohl + amino-quinoline used for chelating $Fe^{2+}$ | 6.0 | 40 | 30 | No generation for 2 hrs. | Carburizing | 46.6 | 2–3 | 0.8–1.0 | ○ |
| | | | | | | | Nitriding | 45.9 | 2–3 | 0.9–1.5 | ○ |
| Example 17 | 17-1 | ethanohl + nitro-naphthol used for chelating $Fe^{2+}$ | 8.0 | 40 | 25 | No generation for 2 hrs. | Carburizing | 42.5 | 2–3 | 0.8–1.0 | ○ |
| | | | | | | | Nitriding | 43.8 | 2–3 | 0.9–1.5 | ○ |
| Example 18 | 18-1 | Chelating agent for chelating $Fe^{2+}$ preliminarily added | 2.5 | 50 | 20 | No generation for 2 hrs. | Carburizing | 41.3 | 2–3 | 0.8–1.0 | ○ |
| | | | | | | | Nitriding | 44.6 | 2–3 | 0.9–1.5 | ○ |
| Example 19 | 19-1 | Chelating agent for chelating $Fe^{2+}$ preliminarily added | 2.0 | 40 | 15 | No generation for 2 hrs. | Carburizing | 42.1 | 2–3 | 0.8–1.0 | ○ |
| | | | | | | | Nitriding | 45.8 | 2–3 | 0.9–1.5 | ○ |

TABLE 4

| | Disk | Electrolytic condition: Current density (A/dm$^2$) | Electrolytic condition: Temperature (C.°) | Electrolytic condition: Time (min) | Pretreating method | Deposition state of sulfurizing layer: S count number (Kcps) | Deposition state of sulfurizing layer: Thickness of layer (μm) | Deposition state of sulfurizing layer: Surface Roughness (μm) | Wear test by ball-on-disk tester: Wear amount of ball (× $10^{-4}$ mm$^3$) | Wear test by ball-on-disk tester: Wear amount of Disc (× $10^{-4}$ mm$^3$) |
|---|---|---|---|---|---|---|---|---|---|---|
| | | | | | Carburized Material | | | | | |
| Comparative | A-1 | — | — | — | Chemical | — | — | 0.8–1.0 | 1049 | 81 |
| | A-2 | — | — | — | Physical | — | — | 0.9–1.2 | 1995 | 137 |
| Example 9 | B-1 | 3.0 | 40 | 6 | Chemical | 11.9 | 2–3 | 0.8–1.0 | 561 | 73 |
| | B-2 | 3.0 | 40 | 6 | Physical | 13.1 | 2–3 | 0.9–1.2 | 1366 | 116 |
| | C-1 | 3.0 | 40 | 10 | Chemical | 21.9 | 3–4 | 0.8–1.0 | 359 | 57 |
| | C-2 | 3.0 | 40 | 10 | Physical | 22.6 | 3–4 | 0.9–1.2 | 953 | 81 |
| | D-1 | 3.0 | 40 | 25 | Chemical | 30.3 | 4–5 | 0.8–1.0 | 157 | 57 |
| | D-2 | 3.0 | 40 | 25 | Physcial | 33.6 | 4–5 | 0.9–1.2 | 581 | 78 |
| Example 14 | E-1 | 5.0 | 30 | 5 | Chemical | 12.3 | 1 or less | 0.8–1.0 | 359 | 66 |
| | E-2 | 5.0 | 30 | 5 | Physical | 13.3 | 1 or less | 0.9–1.2 | 1179 | 73 |
| | F-1 | 5.0 | 30 | 10 | Chemical | 21.3 | 1–2 | 0.8–1.0 | 75 | 45 |
| | F-2 | 5.0 | 30 | 10 | Physical | 23.2 | 1–2 | 0.9–1.2 | 305 | 54 |
| | G-1 | 5.0 | 30 | 15 | Chemical | 31.2 | 1–2 | 0.9–1.2 | 47 | 38 |
| | G-2 | 5.0 | 30 | 15 | Physical | 32.9 | 1–2 | 0.9–1.2 | 57 | 47 |
| | H-1 | 5.0 | 30 | 20 | Chemical | 40.4 | 1.5–3.0 | 0.8–1.0 | 22 | 40 |
| | H-2 | 5.0 | 30 | 20 | Physical | 44.9 | 1.5–3.0 | 0.9–1.2 | 33 | 43 |
| | | | | | Nitrieded Material | | | | | |
| Comparative | K-1 | — | — | — | None | — | — | 0.9–1.5 | 788 | 43 |
| | K-2 | — | — | — | Physical | — | — | 1.0–1.2 | 695 | 38 |
| Example 9 | L-1 | 3.0 | 40 | 6 | None | 12.8 | 2–3 | 0.9–1.5 | 667 | 42 |
| | L-2 | 3.0 | 40 | 6 | Physical | 13.1 | 2–3 | 0.9–1.2 | 623 | 37 |
| | M-1 | 3.0 | 40 | 10 | None | 23.1 | 3–4 | 0.9–1.5 | 561 | 40 |
| | M-2 | 3.0 | 40 | 10 | Physical | 22.6 | 3–4 | 0.9–1.2 | 435 | 36 |
| | N-1 | 3.0 | 40 | 25 | None | 32.7 | 4–5 | 0.9–1.5 | 305 | 40 |
| | N-2 | 3.0 | 40 | 25 | Physical | 31.6 | 4–5 | 1.0–1.2 | 293 | 37 |

TABLE 4-continued

| | | Electrolytic condition | | | | Deposition state of sulfurizing layer | | | Wear test by ball-on-disk tester | |
|---|---|---|---|---|---|---|---|---|---|---|
| | Disk | Current density (A/dm$^2$) | Temperature (C.°) | Time (min) | Pretreating method | S count number (Kcps) | Thickness of layer ($\mu$m) | Surface Roughness ($\mu$m) | Wear amount of ball ($\times 10^{-4}$ mm$^3$) | Wear amount of Disc ($\times 10^{-4}$ mm$^3$) |
| Example 14 | O-1 | 4.0 | 30 | 5 | None | 13.1 | 1 or less | 0.9–1.5 | 451 | 41 |
| | O-2 | 4.0 | 30 | 5 | Physical | 12.3 | 1 or less | 1.0–1.2 | 302 | 36 |
| | P-1 | 4.0 | 30 | 10 | None | 21.9 | 1–2 | 0.9–1.5 | 359 | 40 |
| | P-2 | 4.0 | 30 | 10 | Physical | 20.9 | 1–2 | 1.0–1.2 | 316 | 37 |
| | Q-1 | 4.0 | 30 | 15 | None | 33.4 | 1–2 | 0.9–1.5 | 57 | 40 |
| | Q-2 | 4.0 | 30 | 15 | Physical | 32.9 | 1–2 | 1.0–1.2 | 50 | 37 |
| | R-1 | 4.0 | 30 | 20 | None | 46.5 | 1.5–3.0 | 0.9–1.5 | 42 | 39 |
| | R-2 | 4.0 | 30 | 20 | Physical | 44.9 | 1.5–3.0 | 1.0–1.2 | 37 | 37 |

What is claimed is:

1. A method for forming a wear resistant sulfurizing layer composed of iron sulfide, in which iron oxide is mixed, comprising the steps:

preparing an alkaline electrolytic solution, which contains ferric ions, a first chelating agent for chelating the ferric ions and a sulfur compound, and which has a pH of 9 or more;

dipping a workpiece as a cathode in the alkaline electrolytic solution; and, carrying out electrolysis in the alkaline electrolytic solution, thereby depositing the wear resistant sulfurizing layer on the cathode.

2. A method according to claim 1, wherein the molar concentration of the ferric ions in the electrolytic solution is from 0.05 to 0.5 mol/L.

3. A method according to claim 1 or 2, wherein the first chelating agent is water soluble, and the molar concentration of the first chelating agent is twice or more relative to the molar concentration of the ferric ions and is in a range of from 0.1 to 2.0 mol/L in the electrolytic solution.

4. A method according to claim 3, wherein said water-soluble chelating agent is alkaline, and, a stability constant of a chelate compound of the ferric ions formed by the first chelating agent is higher than a stability constant of a chelating compound of ferrous ions formed by the first chelating agent.

5. A method according to claim 1 or 2, wherein the molar concentration of the sulfur compound is from 1/10 to 20/10 relative to the molar concentration of the ferric ions and is from 0.005 to 1.0 mol/L in the electrolytic solution.

6. A method according to claim 1 or 2, wherein the electrolytic solution further contains a nitrite at a molar concentration of from 1/5 to 1/1 relative to the molar concentration of the sulfur compound and in a range of from 0.001 to 1.0 mol/L in the electrolytic solution.

7. A method according to claim 6, wherein the electrolytic solution further contains a second chelating agent for chelating ferrous ions, having at least one member selected from the group consisting of $NH_3$ and $NO_2$, and further a stability constant of a chelate compound of ferrous ions formed by the second chelating agent is lower than a stability constant of a chelating compound of ferric ions formed by the first chelating agent.

8. A method according to claim 7, wherein the molar concentration of the second chelating agent is from 1/5 to 8/5 times relative to the molar concentration of the ferric ions and is in a range of from 0.01 to 0.8 mol/L in the electrolytic solution.

9. A method according to claim 1 or 2, wherein the temperature of electrolytic solution is from 15 to 60° C.

10. A method according to claim 1 or 2, wherein the current density is from 0.3 to 12 A/dm$^2$.

11. A method for forming a wear resistant sulfurizing layer composed of iron sulfide, in which iron oxide is mixed, comprising the steps:

preparing an alkaline electrolytic solution, which contains ferric ions, a first chelating agent for chelating the ferric ions, a ferrous chelate compound chelated by a second chelating agent which has $NH_3$ or $NO_2$ group, and a sulfur compound, and which has a pH of 9 or more;

dipping a workpiece as a cathode in the alkaline electrolytic solution; and, carrying out electrolysis in the alkaline electrolytic solution, thereby depositing the wear resistant sulfurizing layer on the cathode.

12. A method according to claim 11, wherein the electrolytic solution further contains a third chelating agent for chelating ferrous ions formed during the electrolysis.

13. A method according to claim 11, wherein the molar concentration of the second chelating agent is from 1/10 to 5/10 relative to the molar concentration of the ferrous ions and is in a range of from 0.05 to 0.25 mol/L.

14. A method according to claim 11, 12 or 13, wherein the temperature of electrolytic solution is from 15 to 60° C.

15. A method according to claim 11, 12 or 13, wherein the current density is from 0.3 to 12 A/dm$^2$.

16. An iron-based material having a wear-resistant layer having a thickness of from 5 $\mu$m or less, composed of iron sulfide, and in which iron oxide is mixed, said wear-resistant layer being produced by a method comprising the steps of:

preparing an alkaline electrolytic solution, which contains ferric ions, a first chelate agent for chelating the ferric ions and a sulfur compound, and which has a pH of 9 or less;

dipping a workpiece as a cathode in the alkaline electrolytic solution; and carrying out electrolysis in the alkaline electrolytic solution, thereby depositing the wear resistant layer on the cathode.

17. An iron-based material according to claim 16, wherein said wear resistant layer has a surface roughness of the iron-based material prior to the electrolysis, not appreciably influenced by the electrolysis.

* * * * *